US010435943B2

(12) United States Patent
Rowley et al.

(10) Patent No.: US 10,435,943 B2
(45) Date of Patent: Oct. 8, 2019

(54) ROLLER SHUTTER

(71) Applicant: System 2000 Group Limited, Birmingham (GB)

(72) Inventors: John Edward Rowley, Birmingham (GB); Robert Albert Rowley, Staffordshire (GB)

(73) Assignee: System 2000 Group Limited, Birmingham (GB)

( * ) Notice: Subject to any disclaimer, the term of this patent is extended or adjusted under 35 U.S.C. 154(b) by 0 days.

(21) Appl. No.: 14/652,402

(22) PCT Filed: Dec. 16, 2013

(86) PCT No.: PCT/GB2013/053302

§ 371 (c)(1),
(2) Date: Jun. 16, 2015

(87) PCT Pub. No.: WO2014/091251

PCT Pub. Date: Jun. 19, 2014

(65) Prior Publication Data

US 2015/0322711 A1 Nov. 12, 2015

(30) Foreign Application Priority Data

Dec. 14, 2012 (GB) ..... 1222642.9

(51) Int. Cl.
*E06B 9/15* (2006.01)
*E06B 9/171* (2006.01)
(Continued)

(52) U.S. Cl.
CPC ..... *E06B 9/15* (2013.01); *E04F 10/10* (2013.01); *E04H 4/082* (2013.01); *E06B 9/165* (2013.01);
(Continued)

(58) Field of Classification Search
CPC ..... E06B 2009/587; E06B 2009/6872; E06B 2009/6881; E06B 2009/1583;
(Continued)

(56) References Cited

U.S. PATENT DOCUMENTS 2,958,083 A * 11/1960 Shook ..... B63B 19/21 160/193
3,019,450 A * 2/1962 Karasiewicz ..... E04H 4/101 160/133
(Continued)

FOREIGN PATENT DOCUMENTS

CA 1224402 A1 7/1987
DE 3107404 A1 9/1982
(Continued)

OTHER PUBLICATIONS

International Search Report and Written Opinion dated Jul. 16, 2014 from International Patent Application No. PCT/GB2013/053302 filed Dec. 16, 2013.
(Continued)

*Primary Examiner* — Katherine W Mitchell
*Assistant Examiner* — Jeremy C Ramsey
(74) *Attorney, Agent, or Firm* — David B. Tingey; Bryant J. Keller; Kirton McConkie

(57) ABSTRACT

A roller shutter comprising a shutter moveable between a retracted position and an extended position is described. The shutter comprises one or more laths wherein the one or more laths comprise first and second surfaces mechanically connected by first and second sides and one or more internal supports. The one or more internal supports are configured to collapse preferentially with respect to the first and second sides. The presence of the one or more internal supports provides the laths with increased mechanical strength. However, by configuring the internal supports to collapse pref-
(Continued)

erentially with respect to the first and second sides provides a means for absorbing and dissipating this force through the shutter. The roller shutter finds particular application as a horizontal shutter within heavy industry environments.

34 Claims, 7 Drawing Sheets

(51) Int. Cl.

| | |
|---|---|
| ***E04F 10/10*** | (2006.01) |
| ***E04H 4/08*** | (2006.01) |
| ***E06B 9/165*** | (2006.01) |
| ***E06B 9/17*** | (2006.01) |
| ***E06B 9/58*** | (2006.01) |
| ***E06B 9/68*** | (2006.01) |

(52) U.S. Cl.
CPC ..... *E06B 9/171* (2013.01); *E06B 9/17007* (2013.01); *E06B 9/581* (2013.01); *E06B 9/582* (2013.01); *E06B 9/68* (2013.01); *E06B 2009/1505* (2013.01); *E06B 2009/1533* (2013.01); *E06B 2009/1538* (2013.01); *E06B 2009/1577* (2013.01); *E06B 2009/1583* (2013.01)

(58) Field of Classification Search
CPC ..... E06B 2009/1577; E06B 2009/1505; E06B 2003/1533; E06B 2009/1538; E06B 2009/1544; E06B 2009/1516; E06B 2009/1594; E06B 9/58; E04H 4/101; E04H 4/802; E05B 9/15
USPC ..... 160/310, 133; 4/502
See application file for complete search history.

(56) References Cited

U.S. PATENT DOCUMENTS 3,484,812 A * 12/1969 Holland ..... E05D 15/165 16/97
4,467,853 A * 8/1984 Downey, Jr. ..... E06B 9/15 160/133
5,586,592 A 12/1996 McGregor
5,718,276 A * 2/1998 Rekret ..... E05D 15/242 160/201
6,021,837 A * 2/2000 Miller ..... E06B 9/165 160/133
6,095,225 A * 8/2000 Miller ..... E06B 9/15 160/133
6,216,316 B1 * 4/2001 Errichiello ..... E05D 1/02 16/245
6,631,749 B1 * 10/2003 Zabala ..... E06B 9/581 160/133
6,672,362 B1 * 1/2004 Mullet ..... E05D 15/165 16/225
7,010,817 B2 * 3/2006 Smith ..... E04H 4/101 220/645
7,090,430 B1 8/2006 Fletcher
7,100,665 B2 * 9/2006 Miller ..... E06B 9/581 160/133
7,451,799 B2 * 11/2008 Sanchez ..... E06B 9/86 160/133
2003/0024659 A1 * 2/2003 Begni ..... E06B 9/15 160/235
2003/0084503 A1 * 5/2003 Epple ..... E04H 4/101 4/502
2005/0205221 A1 9/2005 Miller
2007/0012409 A1 1/2007 Twina
2011/0277945 A1 * 11/2011 Schwerzmann ..... E04H 4/082 160/310

FOREIGN PATENT DOCUMENTS

GB 2321489 A 7/1998
WO 0238905 A2 5/2002

OTHER PUBLICATIONS

International Preliminary Report on Patentability dated Jun. 16, 2015 from International Patent Application No. PCT/GB2013/053302 filed Dec. 16, 2013.

* cited by examiner

ROLLER SHUTTER

The present invention relates to the field of roller shutters. A roller shutter that is capable of withstanding large impact loads is described. Such roller shutters find particular application as a horizontal shutter within heavy industry environments.

In heavy industry environments (e.g. hydrocarbon, iron ore, coal production industries or shipbuilding to name but a few) there often exist working environments where workers are required to work below an open overhead area. In such environments there is a real risk that objects can fall through the exposed overhead area resulting in injury or even death to one or more of the workers below.

A particular example of such open overhead areas are moon pools. Moon pools are commonly found on marine drilling platforms, drill ships and diving support vessels, marine research and underwater exploration or research vessels. It is an opening in the floor or base of the hull, platform, or chamber giving access to the water below, thus allowing technicians or researchers to lower tools and instruments into the sea. Moon pools also allow divers or small submersible craft to enter or leave the water easily and in a more protected environment. In the hydrocarbon production industry moon pools are employed for drilling at sea or in lakes so as to provide a means to pass drilling equipment into the water from a platform or drillship. In these environments drill pipes need to run vertically through the structure or hull and the moon pool provides the means to do this.

The normal working practice in the hydrocarbon production industry when workers are required to work below a moon pool is for the production process to be suspended thus reducing the risk of injury or death to the workers. Suspension of hydrocarbon production is obviously highly undesirable because of the significant loss of revenue to the operator.

It is therefore recognised in the present invention that considerable advantage is to be gained in the provision of a shutter that is able to be selectively deployed with a horizontal aperture so as to provide physical protection for personnel located in a working environment below the aperture area.

SUMMARY OF INVENTION

According to a first aspect of the present invention there is provided a roller shutter the roller shutter comprising a shutter moveable between a retracted position and an extended position, the shutter comprising one or more laths wherein the one or more laths comprise first and second surfaces mechanically connected by first and second sides and one or more internal supports and wherein the one or more internal supports are configured to collapse preferentially with respect to the first and second sides.

The presence of the one or more internal supports provides the laths with increased mechanical strength. However, by configuring the internal supports to collapse preferentially with respect to the first and second sides provides a means for absorbing and dissipating this force through the shutter i.e. they acts as a preferential collapse zone. Any deformation of the shutter is therefore found to concentrate on the surface upon which the impact force is incident with little or no deformation on the opposite surface.

Preferably the one or more internal supports comprise a circular recess. Most preferably the circular recess comprises an opening.

Preferably the first side comprises a first coupling mechanism. Similarly the second side preferably comprises a second coupling mechanism. Most preferably the cross-section profiles of the first and second coupling mechanisms are complementary. With this arrangement two or more laths can readily engage with one another so as to form the shutter.

Optionally an outward facing side of the first surface comprises a plurality of first ridges. The combined effect of these first ridges is to provide the shutter with an anti-slip surface.

Most preferably an outward facing side of the second surface comprises a plurality of second ridges. The combined effect of these second ridges is to provide the shutter with a drive engaging surface.

Preferably the roller shutter further comprises one or more wheel mechanisms. The wheel mechanisms may comprise an axle located at the end of which is a wheel. Preferably the wheel mechanism is attached to the lath be locating the axle in the circular recess. The axle may be tapered towards a distal end thereof.

Preferably a distal end of the axle comprises a tapered barb. The presence of the tapered barb provides a substantially unidirectional fitting arrangement between the axle and the lath.

The wheels may comprise a tapered external surface.

Most preferably the wheels comprise an anti-static material.

The roller shutter preferably comprises two guides positioned on opposite sides of the shutter.

The guides preferably comprise a support post attached to which is a main angle and a secondary angle that define a guide channel for one or more wheels wherein the secondary angle comprises a section that is orientated in a non perpendicular manner to the support post.

The incorporation of the section orientated in a non perpendicular manner to the support post provides an interface for restricting the further movement of a wheel following an impact force incident upon the shutter.

Most preferably the section comprises an asymmetric V-shaped section wherein the apex of the V shaped section is orientated away from the main angle.

Optionally a first rectangular cross section conduit is located on top of the main angle. Preferably the first rectangular cross section conduit has its longer sides orientated substantially perpendicular to the support post.

Optionally a second rectangular cross section conduit is located between the first rectangular cross section conduit and the support post. Preferably the second rectangular cross section conduit has its longer sides orientated substantially parallel to the support post.

The second rectangular section preferably comprises an open side. Preferably the open side is located adjacent to the support post.

Optionally a first, substantially planar section of the second angle is attached to the support post and locates between the second rectangular cross section conduit and the support post.

The roller shutter may further comprise a cartridge for housing the shutter when in the retracted position.

Preferably the cartridge comprises a roller mounted within a support frame wherein the roller is attached to one end of the shutter. As a result rotation of the roller causes the shutter to move between the retracted and extended position.

Preferably the support frame comprises a roll guide plate.

Most preferably the support frame further comprises a channel that extends across the length of the support frame and through which the shutter passes when moving between the retracted and extended positions.

Most preferably the roller shutter further comprises a drive mechanism employed to control the rotational movement of the roller.

Preferably the drive mechanism comprises a tractor belt drive mechanism having one or more tractor belt located at the channel so as to engage with the shutter and a first motor the operation of which drives the one or more tractor belts.

Most preferably the outer surface of the one or more tractor belt engages with the outer facing side of the second surface of the laths. Optionally the outer profile of the one or more tractor belts is complementary to that of the outward facing side of the second surface.

Optionally the channel further comprises a bias means that acts to bias the shutter onto the at least one tractor belt. Preferably the bias means comprises one or more wheels that engage with the first surface of the laths.

The tractor belt drive mechanism preferably comprises a tractor belt located at both sides of the channel.

Most preferably the drive mechanism further comprises a tension drive mechanism having a second motor that is employed to control the rotational movement of the roller.

Most preferably the drive mechanism further comprises a control unit that provides a means for monitoring the extent of the shutter wound onto the roller. Preferably the control unit also provides a means for varying the relative operational speeds of the first and second motors.

According to a second aspect of the present invention there is provided a lath for a roller shutter the lath comprising first and second surfaces mechanically connected by first and second sides and one or more internal supports wherein the one or more internal supports are configured to collapse preferentially with respect to the first and second sides.

Embodiments of the second aspect of the present invention may comprise features to implement the preferred or optional features of the first aspect of the invention or vice versa.

According to a third aspect of the present invention there is provided a guide for a roller shutter the guide comprising a support post attached to which is a main angle and a secondary angle that define a guide channel for one or more wheels wherein the secondary angle comprises a section that is orientated in a non perpendicular manner to the support post.

Embodiments of the third aspect of the present invention may comprise features to implement the preferred or optional features of the first or second aspects of the invention or vice versa.

According to a fourth aspect of the present invention there is provided a drive mechanism for a roller shutter having a shutter mechanically connected to a roller the drive mechanism comprising a first drive mechanism that is engaged with the shutter and a second drive mechanism that is engaged with the roller.

The incorporation of the second drive mechanism that is engaged with the roller allows the drive mechanism to control the tension in the shutter as it is being wound onto the roller by the first drive mechanism. As a result the drive mechanism reduces the risk of snagging or jamming during the operation of the roller shutter.

Preferably the first drive mechanism comprises a tractor belt drive mechanism having one or more tractor belts located to engage with the shutter and a first motor the operation of which drives the one or more tractor belts.

Most preferably the second drive mechanism comprises a tension drive mechanism having a second motor that is employed to control the rotational movement of the roller.

Most preferably the drive mechanism further comprises a control unit that provides a means for monitoring the extent of the shutter wound onto the roller.

Preferably the control unit also provides a means for varying the relative operational speeds of the first and second drive mechanisms.

Embodiments of the fourth aspect of the present invention may comprise features to implement the preferred or optional features of the first to third aspects of the invention or vice versa.

According to a fifth aspect of the present invention there is provided a method for winding a shutter onto a roller the method comprising employing a first drive mechanism to engage with the shutter so as to provide a means for winding the shutter onto the roller; and employing a second drive mechanism to engage with the roller so as to provide a means for controlling the tension in the shutter as it is wound onto the roller.

Preferable the method for winding the shutter onto the roller further comprises monitoring the extent of the shutter wound onto the roller.

Most preferably the method for winding the shutter onto the roller further comprises varying the relative operational speeds of the first and second drive mechanisms.

BRIEF DESCRIPTION OF DRAWINGS

Aspects and advantages of the present invention will become apparent upon reading the following detailed description and upon reference to the following drawings in which:

FIG. 3 provides a side representation of:

Figure 1:
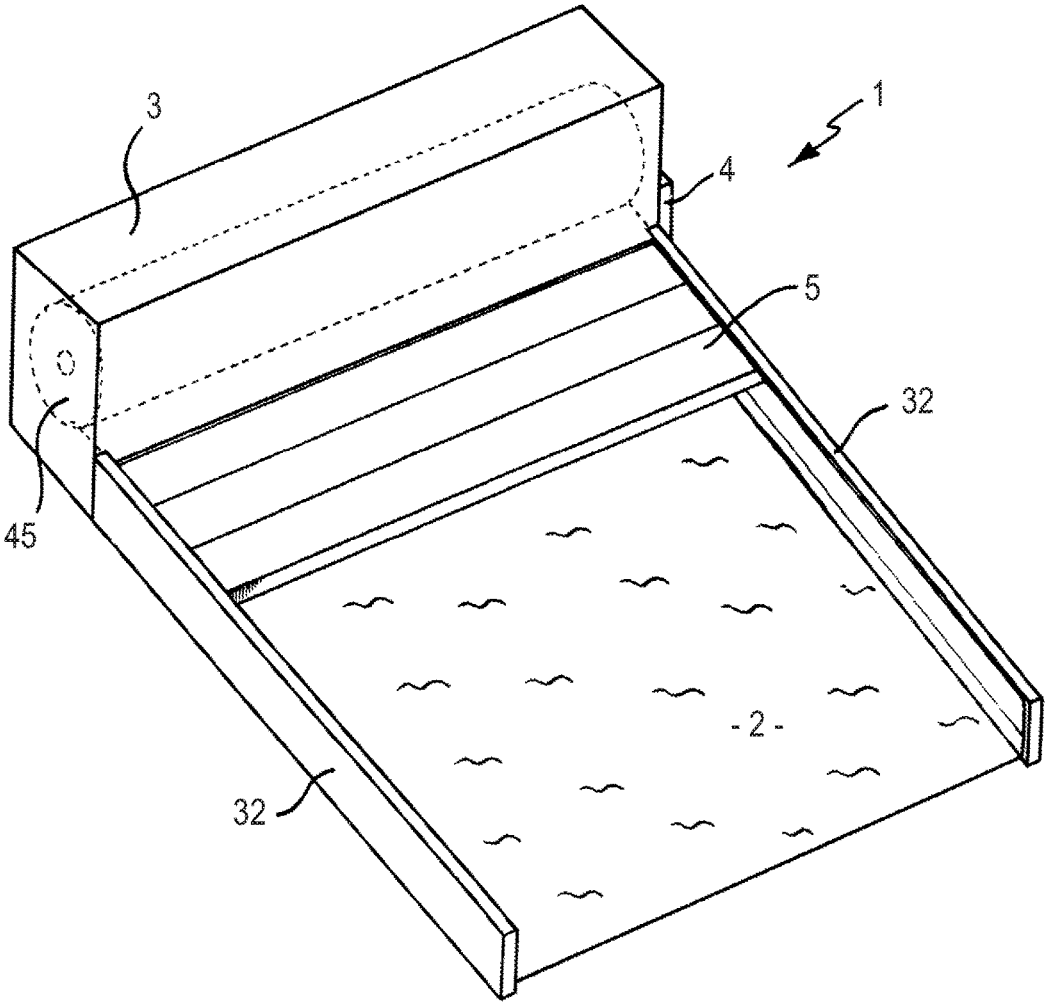
FIG. 1 presents a schematic representation of a roller shutter in accordance with an embodiment of the present invention deployed with a moon pool.
Figure 2:
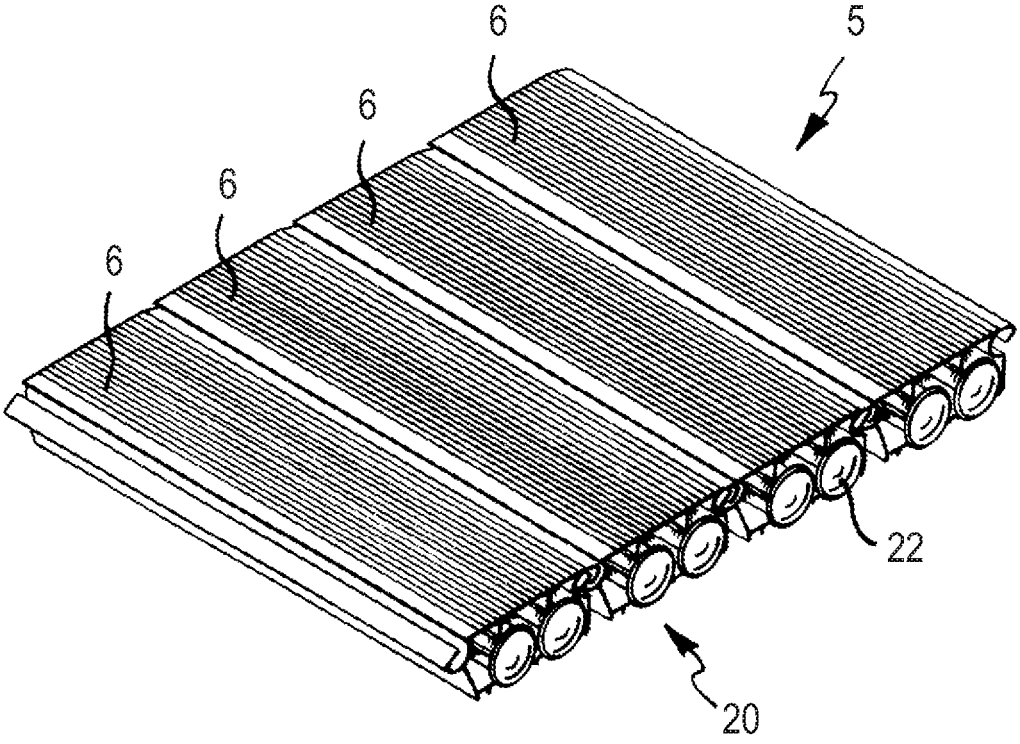
FIG. 2 presents a schematic representation of a shutter of the roller shutter of FIG. 1 in an extended position.
Figure 4:
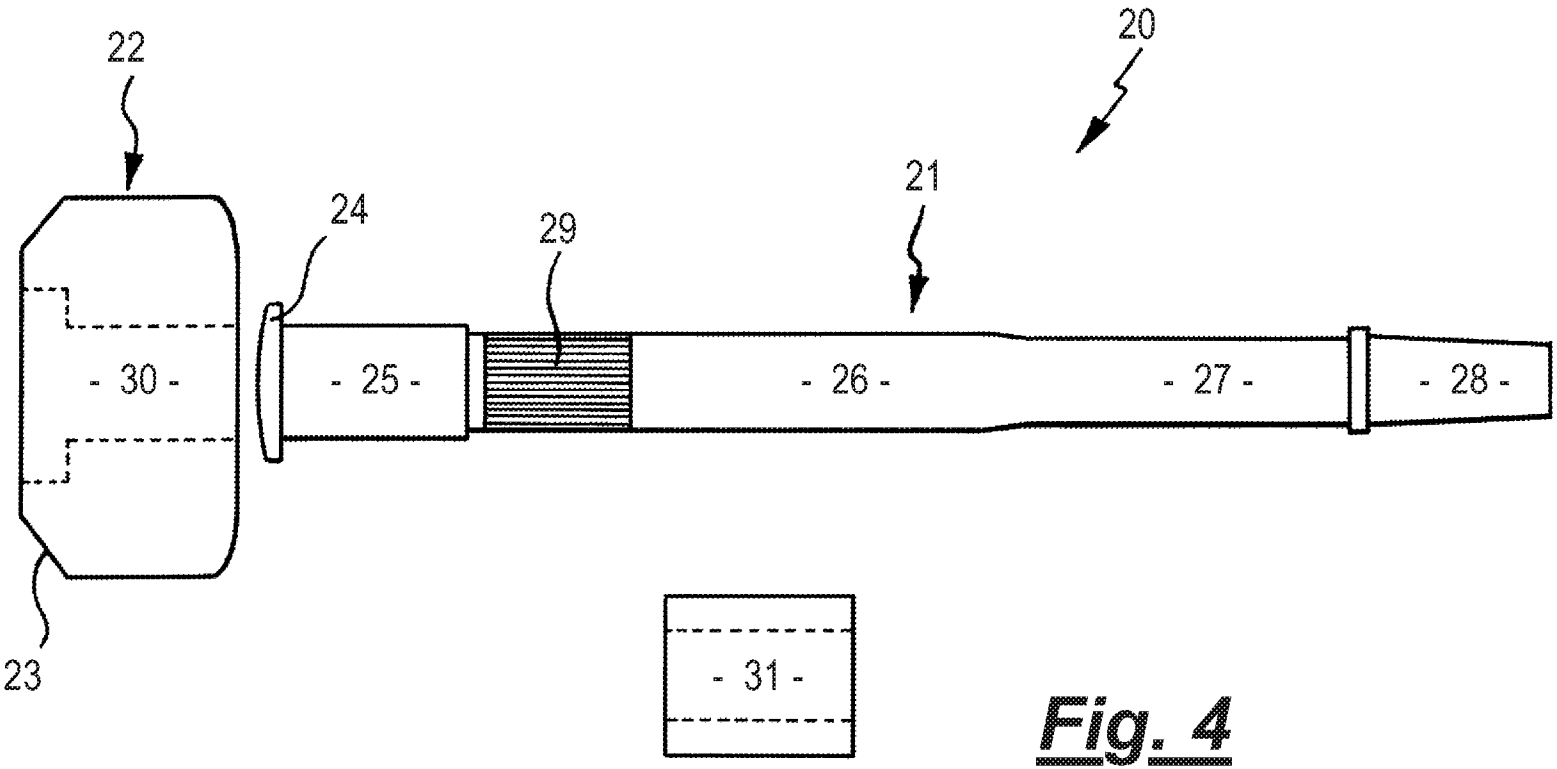
Figure 5:
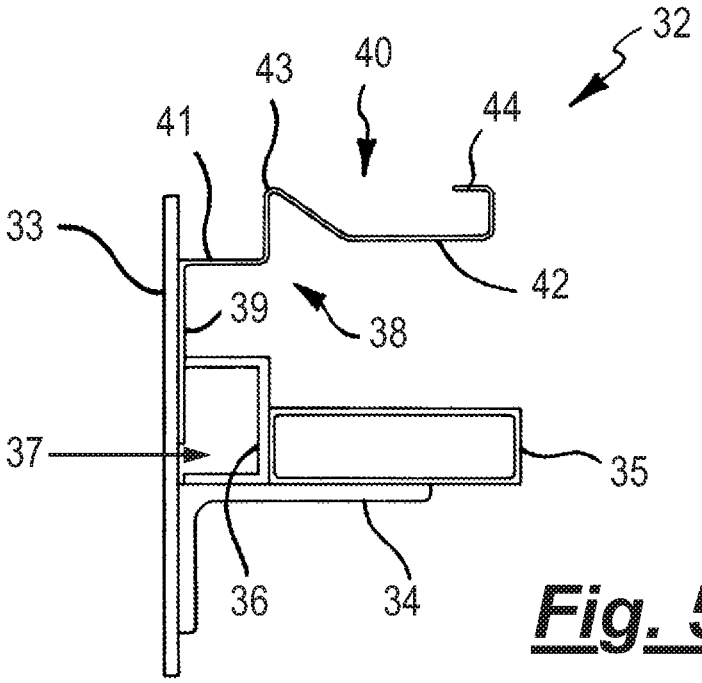
Figure 6:
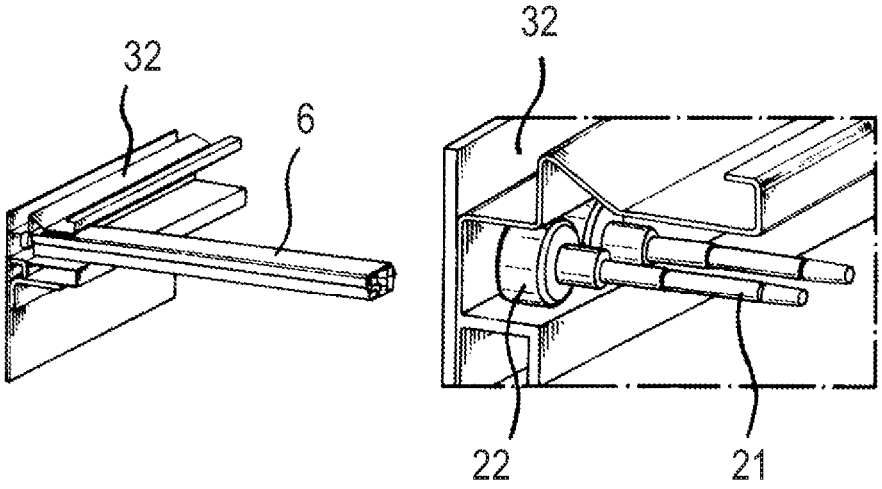

(a) a single lath of the shutter of FIG. 2;

(b) the connection of two laths of the shutter of FIG. 2;

FIG. 4 provides an exploded view of a wheel mechanism of the shutter of FIG. 2;

FIG. 5 provides a side representation of a guide of the roller shutter of FIG. 1;

FIG. 6 provides a schematic representation of:

(a) a single lath; and (b) the wheels of the single lath of the shutter of FIG. 2 connected to the guide of FIG. 4;

FIG. 7 provides a:

(a) a plan representation; and (b) a side representation, of a cartridge and drive mechanism of the roller shutter of FIG. 1.

In the description which follows, like parts are marked throughout the specification and drawings with the same reference numerals. The drawings are not necessarily to scale and the proportions of certain parts have been exaggerated to better illustrate details and features of embodiments of the invention.

DETAILED DESCRIPTION

Roller shutters are known to be employed in a variety of substantially vertical applications e.g. as rolling grilles;

storm doors; fire and smoke doors; air-leakage doors, counter shutters; and, the like. What they all have in common is a construction that allows them to be vertically rolled up onto a drum or cartridge when in the open position; or, to be vertically unreeled from the cartridge when the shutter is being lowered. These shutters are typically used in commercial establishments to seal or close off large doorways, or bays, and can be operated electrically, manually, or both. However, the design of these shutters do not readily lend themselves for deployment in a substantially horizontal plane, nor do they have the mechanical strength necessary to withstand the impacts loads that they may be subjected to within a heavy industry environment.

A roller shutter, depicted generally by reference numeral 1, deployed with a moon pool 2 and which addresses these issues is presented in FIG. 1. From FIG. 1 the roller shutter 1 can be seen to comprise a cartridge 3 and drive mechanism 4 located at one end of the moon pool 2 and a shutter 5, which presented in a partially extended position from the cartridge 3 so as to provide physical cover to the moon pool 2.

Figure 3A:
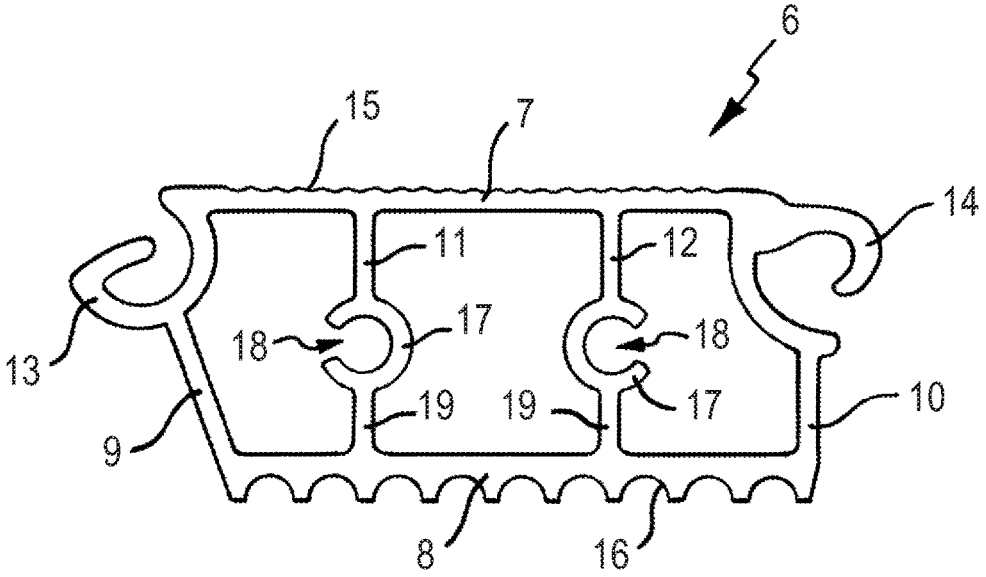
Figure 3B:
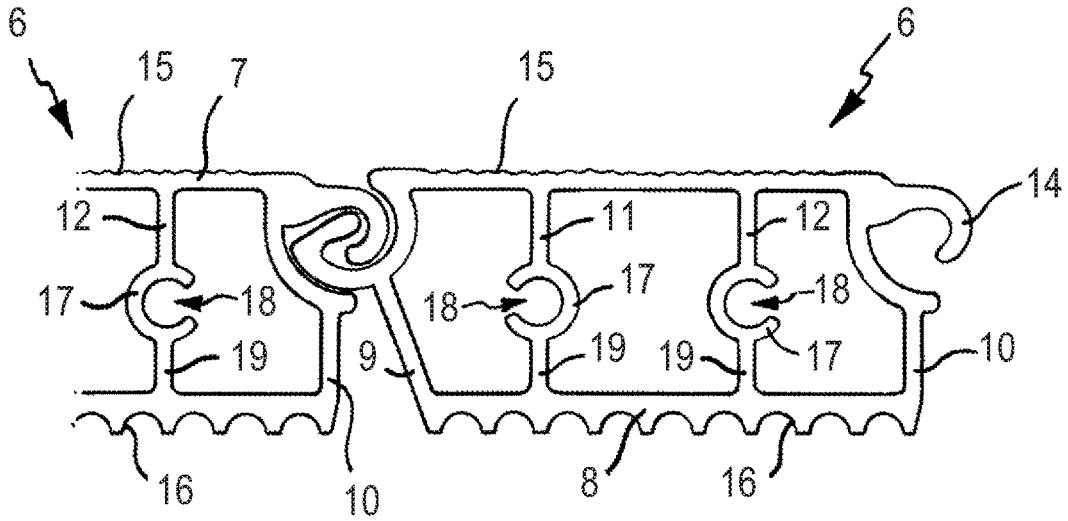

Further detail of the shutter 5 will now be provided with reference to FIGS. 2 and 3 which present a schematic representation and partial side views of the shutter 5 respectively. The shutter can be seen to comprise a plurality of laths 6. Each lath 6 is extruded from aluminium and may have a length of around 6,700 mm, a width of around 180 mm and a depth of around 70 mm.

Each lath 6 can be seen to comprise a first surface 7 and a second surface 8, the second surface 8 being substantially parallel to the first 7. The first 7 and second surfaces 8 are mechanically connected by first 9 and second sides 10 and by two internal supports 11 and 12. It will be appreciated that alternative embodiments of the lath may comprise just one internal support or more than two internal supports. The first side 9 comprises a first coupling mechanism 13 in the form of a hook orientated towards the first surface 7. Similarly, the second side 10 comprises a second coupling mechanism 14 in the form of a hook orientated towards the second surface 8. The cross-section profiles of the first 13 and second coupling mechanisms 14 are complementary such that the can readily engage with one another. As a result the first 13 and second coupling mechanisms 14 provide a means for a plurality of laths 6 to be coupled together, as presented in FIG. 3(*b*), while allowing rotational movement of each lath 6 relative to its neighbouring laths 6. In this way a variable shutter length can be produced depending upon the specific deployment requirements by varying the number of laths 6 employed while still allowing for the shutter 5 to be retracted when not in use by winding it up and housing it within the cartridge 3, as will be described in further detail below.

On the outward facing side of the first surface 7 are located a plurality ridges 15. The ridges 15 have a concave cross sectional profile that extends across the length of the lath 6. The ridges 15 are typically around 1 mm in depth. The combined effect of these ridges 15 is to provide the shutter 5 with an anti-slip surface for any personnel requiring to walk across the first surface 7.

In a similar manner there are also located a plurality ridges 16 on the outward facing side of the second surface 7. The ridges 16 again have a concave cross sectional profile that extends across the length of the lath 6. The ridges 16 are typically around 6 mm in depth. The combined effect of these ridges 16 is to provide the shutter 5 with a drive engaging surface that provides a means for the shutter 5 to mechanically engage with the drive mechanism 4, as will be described in further detail below.

The internal supports 11 and 12 both comprise a circular recess 17 having an opening 18 and extending from which are planar sections 19 that provide the attachment means to the first 7 and second surfaces 8. Each circular recess 17 provides a means for a wheel mechanism 20 to be attached to the lath 6.

An exploded view of the wheel mechanism 20 of the shutter is presented in FIG. 4. The wheel mechanisms 20 can be seen to comprise an axle 21 located at one end of which is a wheel 22. The axles 21 may be made from stainless steel while the wheels 22 may be made from nylon. The wheels 22 may comprise a tapered external surface 23. It is most preferable to make the wheels 22 from an anti-static material. Attachment of the wheel mechanism 20 to the lath 6 is achieved by the inserting the axle 21 into the circular recess 17.

It should be further noted that it is preferable for the axles 21 to be tapered towards their distal end, the reasons for which are described in further detail below. In the presently described embodiment, see FIG. 4, this is achieved by a stepwise reduction in the diameter of the axle 21 as it moves from the wheel 22 towards the central position of the shutter 5 or the distal end of the axle 21. It will be appreciated by the skilled reader that in an alternative embodiment the taper may be a continuous taper from the wheel 22 towards the central position of the shutter 5 or the distal end of the axle 21.

From FIG. 4 the axle 21 can be seen to comprise a wheel retaining disc 24, a first section 25 (having a diameter of around 16 mm), a second section 26 (having a diameter of around 13.4 mm), a third section 27 (having a diameter of around 12.5 mm) and circular barb 28 located at the distal end of the axle 21. The circular barb 28 is tapered, tapering from a diameter of 13.4 mm down to 11 mm. Axially orientated knurling 29, is located along a length of the first section 25. The knurling 29 preferably extends around the circumference of the first section 25.

The wheel mechanisms 20 is assembled and located within the lath 6 in the following manner. In the first instance the axle 21 is threaded through a central aperture 30 of the wheel 22 so that the wheel retaining disc 24 is countersunk within the wheel 22.

A spacer 31 is then threaded from the distal end of the axle 21 so as to abut the internal face of the wheel 22.

The circular barb 28 is then pushed into an associated circular recess 17. As this happens the taper of the circular barb 28 forces the circular recess 17 to open. Once the largest diameter section of the circular barb 28 passes through the circular recess 17 the circular recess 17 closes down behind the circular barb 28 so as to secure the axle 21 with the lath 6.

The roller shutter further comprises two guides 32 positioned on opposite sides of the shutter 5. Both guides 32 extend along the direction of expansion of the shutter 5, e.g. along the length of moon pool 2. The guides 32 have been designed to provide additional protection against impact loads for the shutter 5 which will now be discussed in further detail with reference to FIGS. 5 and 6. In particular, FIG. 5 provides a side representation of a guide 32 while FIG. 6 provides schematic representations of (a) a single lath 6 and (b) the wheels 22 of the single lath 6 when located within the guide 32.

Each guide 32 comprises a support post 33 that is substantially vertical orientated when the guide 32 is deployed. Attached to the guide 32 is a main angle 34. Located on top of the main angle 34 is a first rectangular cross section conduit 35 that has its longer sides orientated substantially perpendicular to the support post 33. Located between the first rectangular cross section conduit 35 and the support post 33 is a second rectangular cross section conduit 36 having an open side 37. The second rectangular cross section conduit 36 has its longer side orientated substantially parallel to the support post 33 with the open side 37 being closest to the support post 33. The guide 32 further comprises a second angle 38. A first, substantially planar section 39 of the second angle 38 is attached to the support post 33 such that it locates between the second rectangular cross section conduit 36 and the support post 33 resulting in a second, non planar section 40 extending in a substantially perpendicular orientation from the support post 33. The second section 40 of the second angle 38 can be seen to comprise two non-coplanar, but substantially parallel, planar sections 41 and 42 located between which is an asymmetric V-shaped section 43, the apex of the V being orientated away from the main angle 34. A hooked end 44 is located at the distal end of the second section 40 of the second angle 38.

With reference to FIG. 6, it can be seen that when the shutter 5 is deployed the wheels of the laths 6 are located within a channel between the main angle 34 and the second angle 38, and in particular the upper surface of the second rectangular cross section conduit 36 and the lower surface of the first planar section 41 of second section 40 of the second angle 38. As a result the shutter 5 is guided as it extends from or retracts into the cartridge 3.

It is preferable for the second rectangular cross section conduit 36 to be formed from two or more sections wherein the ends of these sections are cut at an angle. This arrangement allows for an expansion gap to be located between adjacent sections while still allowing for the smooth passage of the wheels 22 along the guides 32. The tapered external surface 23 of the wheels 22 further assists with this process. As a result the roller shutter 1 has been operated by the inventors in a range of temperatures between −20° C. up to 40° C. without any mechanical failure or jamming of the shutter 5 within the guides 32.

Figure 7A:
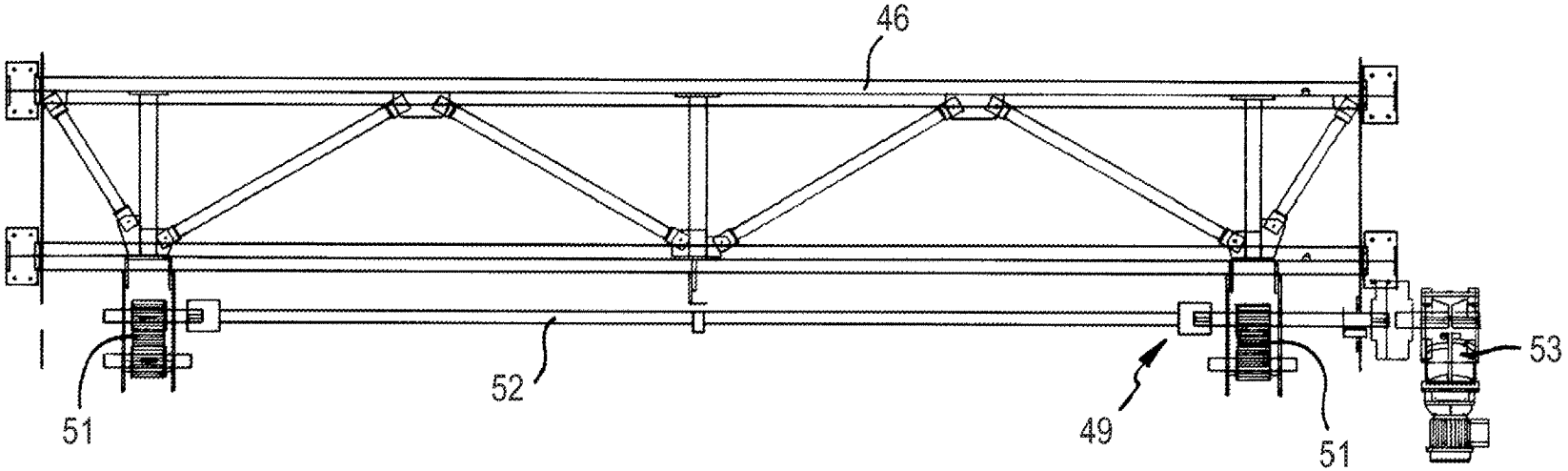
Figure 7B:
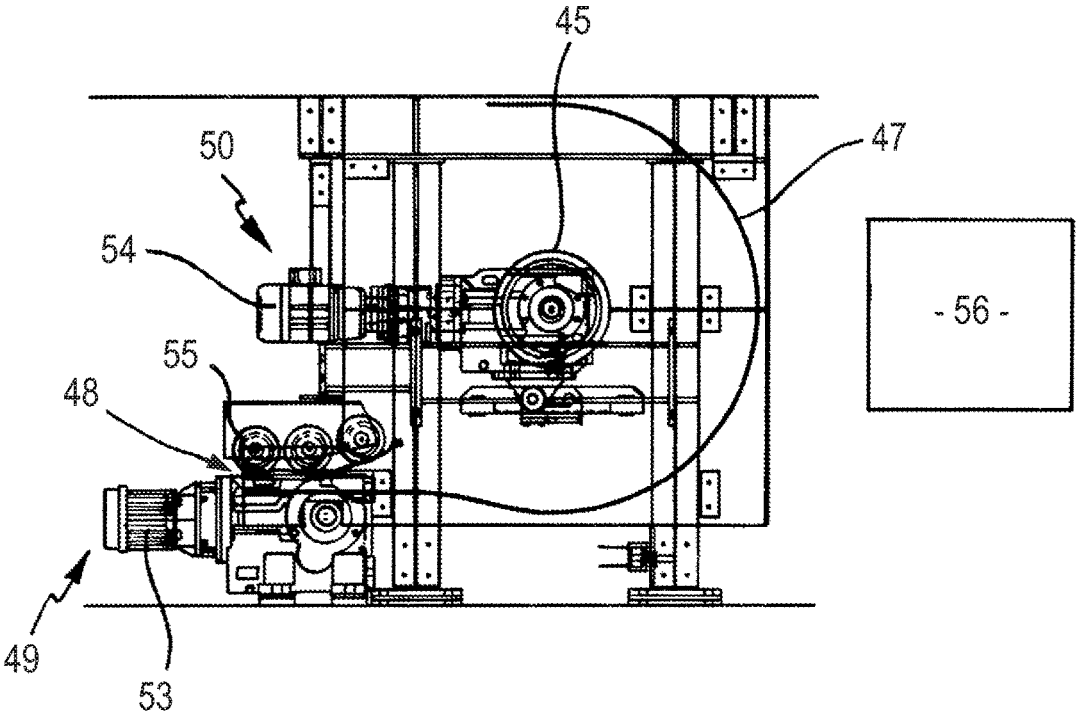

FIG. 7 provides further details of the cartridge 3 and drive mechanism 4 of the roller shutter of FIG. 1. The cartridge 3 can be seen to comprise a roller 45 (omitted from FIG. 7(*a*)) mounted within a support frame 46. The support frame 46 further comprises a roll guide plate 47 and a channel 48 located between the roller 45 and the surface on which the support frame 46 is mounted (e.g. the platform surrounding the moon pool). The channel 48 extends across the length of the support frame 46.

With one end of the shutter 5 attached to the roller 45, a rotational movement of the roller 45 acts, in combination with the roll guide plate 47 to provide a means for the shutter 5 to enter the cartridge and then be wound up onto the roller 45. Reversing the direction of rotation of the roller 45 causes the shutter 5 to unroll from the roller 45 and exit the cartridge 3 via the channel 48.

Rotation of the roller 45 is controlled by the 4 drive mechanism which in the presently described embodiment comprises a tractor belt drive mechanism 49 and a tension drive mechanism 50.

The tractor belt drive mechanism 49 comprises a tractor belt 51 located at either end of the channel 48. A propshaft 52 mechanically connects the two tractor belts 51. One end of the propshaft 52 is also connected to a first motor 53, preferably by a first gearing mechanism (not shown). The outer profile of the tractor belts 51 is complementary to that of the outward facing side of the second surface 7 of the laths 6. Therefore, when the drive engaging surface of the shutter 5 engages with the tractor belts 51, operation of the first motor 53 acts to efficiently extract the shutter 5 from the cartridge 3 by directing the wheels 22 of the laths 6 into the guides 32.

The tension drive mechanism 50 comprises a second motor 54 that is employed to control the rotational movement of the roller 45. The second motor 54 is preferably connected to the roller by a second gearing mechanism (not shown).

It should be noted that there is no requirement for the operation of tension drive mechanism 50 during the extraction of the shutter 5 and this mechanism can simply be left to freewheel at this time. However, the incorporation of one or more vertical control wheels 55 is found to be beneficial to this extraction process. As can be seen from FIG. 7(*b*), the vertical control wheels 55 are located within the channel 48 so as engage with the outward facing side of the first surface 7 of the laths 6. As a result the vertical control wheels 55 act to bias the shutter 5 down onto the tractor belts 51. This allows the roller shutter 1 to operate even during times of high winds which may otherwise cause the shutter 5 to disengage with the tractor belts 51.

In order to retract the shutter 5 the rotational direction of the tractor belts 51 is simply reversed. However, unlike the previously described extraction process, the tension drive mechanism 50 is employed to assist in rotating the roller 45 in the same sense as the tractor belts 51. It will be appreciated that as more of the shutter 5 is wound onto the roller 45 then the rotational speed of the rotor 45 needs to be increased in order to maintain a desired tension between the laths 6 of the shutter 5 as it moves within the cartridge 3 thus reducing the opportunity for problematic snagging or jamming. A control unit 56 therefore provides a means for monitoring the extent of the shutter 5 wound onto the roller 45 and for varying the relative operational speeds of the first 53 and second motors 54 accordingly.

The above described roller shutter 1 exhibits a number of features that enable it to withstand the effects of high impact loads and thus makes it particular suited for use as a horizontal shutter within heavy industry environments. The presently described embodiment was tested by dropping a 25 kg weight from a height of 16 m onto the shutter 5 while extended across a moon pool 2.

In the first instance, the internal supports 11 and 12 provide the laths 6 with increased mechanical strength when compared with laths known in the art. As described above, the circular recesses 17 provide a means for attaching wheel mechanisms 20 to the lath 6 but these circular recesses 17 also provide a further important function. Due to the presence of the opening 18 the internal supports 11 and 12 are not as rigid as the first 9 and second sides 10. As a result when an impact load impacts upon the first surface 7 the internal supports 11 and 12 collapse preferentially with respect to the first 9 and second sides 10 and so provided a means for absorbing and dissipating this force through the shutter 5 i.e. they acts as a preferential collapse zone. Any deformation of the shutter 5 is therefore found to concentrate on the first surface 7 with little or no deformation of the second surface 8. The presence of the internal supports 11 and 12 thus allow the shutter 5 to survive significantly larger impact loads than laths not comprising these components and so the dropped object is prevented from penetrating the shutter 5.

The combination of the guides 32 and the wheel mechanisms 20, referred to below as crumple zones, also provide significant improved impact performance to the roller shutter 1. Prior art roller shutters are known to exhibit impact weak points close to the edges of their shutters. However, with the present arrangement when an impact force is applied to the edge of the shutter 5 the axles 21 of a surrounding wheel mechanism may bend causing the associated wheels 22 to be deflected away from the main angle 34 towards the second section 40 of the second angle 38. However, when the wheels 22 come into contact with the V-shaped section 43 their further movement is prevented and the impact force is thereafter absorbed and dissipated through the shutter 5.

The tapered axles 21 are found to further assist this process. With the above arrangement the inventors have found that an axial force of greater than 2500 N is required to remove a circular barb 28 from its associated circular recess 17. The presence of the knurling 29 and the spacer 31 also provides a means for axial movement of the lath 6 relative to the wheel mechanisms 20 if an impact occurs in close proximity to the edge of the shutter 5. This is found to be advantageous since it reduces the risk of the wheels becoming disengaged from their associated guide 32 following such an impact.

These crumple zones therefore allow for the wheels 22 to remain within the guides 32 following the impact test such that there is no risk that the shutter 5 could fall down into the moon pool 2. Significantly, the roller shutter 1 was found to still be operated following the above described impact tests.

Although the above described tests were carried out by dropping a 25 kg weight from a height onto the shutter 5 while extended across a moon pool 2, subsequent testing has shown the shutter 5 is strong enough to bear the weight of ten to fifteen men walking across or standing on the shutter 5 without any resulting damage.

The above described roller shutter is found to exhibit significantly higher mechanical strength than those roller shutter systems known in the art. In addition, the design of the roller shutter components is such that it is able to withstand impact forces significantly higher than are presently possible with prior art roller shutters. The described drive system of the roller shutter also makes the apparatus less prone to snagging or jamming. As a result of the combination of the above features the described roller shutter is found to be particularly suited for selective deployment with horizontal apertures so as to provide physical protection for personnel located in a working environment below the aperture area. This is found to be particular attractive for use with a moon pool since the deployment of the shutter will reduce the time production requires to be suspended while workers operate in the area below.

A roller shutter comprising a shutter moveable between a retracted position and an extended position is described. The shutter comprises one or more laths wherein the one or more laths comprise first and second surfaces mechanically connected by first and second sides and one or more internal supports. The one or more internal supports are configured to collapse preferentially with respect to the first and second sides. The presence of the one or more internal supports provides the laths with increased mechanical strength. However, by configuring the internal supports to collapse preferentially with respect to the first and second sides provides a means for absorbing and dissipating this force through the shutter. The roller shutter finds particular application as a horizontal shutter within heavy industry environments.

Throughout the specification, unless the context demands otherwise, the terms "comprise" or "include", or variations such as "comprises" or "comprising", "includes" or "including" will be understood to imply the inclusion of a stated integer or group of integers, but not the exclusion of any other integer or group of integers.

Furthermore, reference to any prior art in the description should not be taken as an indication that the prior art forms part of the common general knowledge.

The foregoing description of the invention has been presented for purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention as defined by the appended claims.

The invention claimed is:

1. A moon pool roller shutter comprising:

a shutter moveable between a retracted position and an extended position, the shutter comprising one or more laths wherein the one or more laths each comprise first and second surfaces mechanically connected by first and second sides and one or more internal supports, each lath further comprising one or more wheel mechanisms that each comprise an axle, at least one end of which comprises a wheel, wherein the wheel rotates with respect to the lath, wherein the one or more internal supports each comprise a circular recess within which the axle is located such that a diameter of the axle reduces across a width of the one or more internal supports towards a second end of the axle, and wherein each said circular recess comprises an opening that allows the one or more internal supports to collapse with respect to the first and second sides, including to collapse around a reduced diameter of the axle that is located between the first end and the second end of the axle.

2. The moon pool roller shutter as claimed in claim 1 wherein the one or more internal supports each comprise a planar section that extends from the circular recess to at least one of the first surface and the second surface.

3. The moon pool roller shutter as claimed in claim 1 wherein an outward facing side of the first surface comprises a plurality of first ridges that comprise a drive engaging surface.

4. The moon pool roller shutter as claimed in claim 3 wherein an outward facing side of the second surface comprises a plurality of second ridges that are of a different size than the plurality of first ridges.

5. The moon pool roller shutter as claimed in claim 1 wherein a distal end of the axle comprises a barb that substantially unidirectionally fits the axle within the circular recess.

6. The moon pool roller shutter as claimed in claim 1 wherein the wheel comprises a tapered external surface.

7. The moon pool roller shutter as claimed in claim 1 wherein the roller shutter further comprises two guides positioned on opposite sides of the shutter.

8. The moon pool roller shutter as claimed in claim 7 wherein the guides each comprise a support post having a length that runs substantially perpendicularly to a longitudinal axis of the axle when the shutter is in an extended position and wherein attached to the support post is a main angle and a secondary angle that define a guide channel for the wheel wherein the secondary angle comprises a section that is orientated non-perpendicularly to the support post.

9. The moon pool roller shutter as claimed in claim 8 wherein the section comprises an asymmetric V-shaped section and wherein an apex of the V shaped section is orientated away from the main angle, and wherein the V-shaped section is configured to be disposed above each said wheel when the shutter is in the extended position.

10. The moon pool roller shutter as claimed in claim 8 wherein a first rectangular cross section conduit is located on top of the main angle, and wherein at least a portion of the one or more laths is disposed over the first rectangular cross section conduit when the shutter is in the extended position.

11. The moon pool roller shutter as claimed in claim 10 wherein the first rectangular cross section conduit has longer sides that are orientated substantially perpendicular to the support post.

12. The moon pool roller shutter as claimed in claim 10 wherein a second rectangular cross section conduit is located between the first rectangular cross section conduit and the support post, and wherein each said wheel is disposed over of the second rectangular cross section conduit when the shutter is in the extended position.

13. The moon pool roller shutter as claimed in claim 12 wherein the second rectangular cross section conduit has longer sides that are orientated substantially parallel to the support post.

14. The moon pool roller shutter as claimed in claim 12 wherein the second rectangular section comprises an open side.

15. The moon pool roller shutter as claimed in claim 14 wherein the open side is located adjacent to the support post.

16. The moon pool roller shutter as claimed in claim 12 wherein a first, substantially planar section of the secondary angle is attached to the support post and locates between the second rectangular cross section conduit and the support post.

17. The moon pool roller shutter as claimed in claim 1 wherein the roller shutter further comprises a cartridge for housing the shutter when in the retracted position.

18. The moon pool roller shutter as claimed in claim 17 wherein the cartridge comprises a roller mounted within a support frame and wherein the roller is attached to one end of the shutter.

19. The moon pool roller shutter as claimed in claim 18 wherein the support frame comprises a roll guide plate.

20. The moon pool roller shutter as claimed in claim 18 wherein the support frame further comprises a channel that extends across the length of the support frame and through which the shutter passes when moving between the retracted and extended positions.

21. The moon pool roller shutter as claimed in claim 18 wherein the roller shutter further comprises a drive mechanism employed to control the rotational movement of the roller.

22. The moon pool roller shutter as claimed in claim 20 wherein the roller shutter further comprises a drive mechanism employed to control the rotational movement of the roller wherein the drive mechanism comprises a tractor belt drive mechanism having one or more tractor belts located at the channel to engage with the shutter.

23. The moon pool roller shutter as claimed in claim 22 wherein the tractor belt drive mechanism further comprises a first motor the operation of which drives the one or more tractor belts.

24. The moon pool roller shutter as claimed in claim 22 wherein an outer surface of the one or more tractor belts engages with the outer facing side of the second surface of the laths.

25. The moon pool roller shutter as claimed in claim 24 wherein the outer profile of the one or more tractor belts is complementary to that of the outward facing side of the second surface.

26. The moon pool roller shutter as claimed in claim 22 wherein the channel further comprises a bias means that acts to bias the shutter onto the at least one tractor belt.

27. The moon pool roller shutter as claimed in claim 26 wherein the bias means comprises one or more wheels that engage with the first surface of the laths.

28. The moon pool roller shutter as claimed in claim 22 wherein the tractor belt drive mechanism comprises a tractor belt located at both sides of the channel.

29. The moon pool roller shutter as claimed in claim 21 wherein the drive mechanism further comprises a tension drive mechanism having a second motor that is employed to control the rotational movement of the roller.

30. A moon pool roller shutter comprising:

a shutter moveable between a retracted position and an extended position, the shutter comprising one or more laths wherein the one or more laths comprise first and second surfaces mechanically connected by first and second sides and one or more internal supports, each lath further comprising one or more wheel mechanisms, wherein each one or more wheel mechanisms comprises an axle and a wheel positioned at a first end of the axle, wherein the axle is tapered from the first end towards an opposing second end of the axle, wherein the wheel rotates with respect to the lath, wherein the one or more internal supports each comprise a circular recess within which the axle is located such that a diameter of the tapered axle reduces across a width of the one or more internal supports towards the second end of the axle, and wherein each said circular recess comprises an opening that in combination with the tapered axle enables the one or more internal supports to at least partially collapse with respect to the first and second sides, including to collapse around a reduced diameter of the axle that is located between the first end and the second end of the axle.

31. The moon pool roller shutter as claimed in claim 30 wherein the roller shutter further comprises two guides positioned on opposite sides of the shutter, and wherein each of the guides comprises a first elongated conduit on top of which each said wheel rests when the shutter is in the extended position.

32. The moon pool roller shutter as claimed in claim 31 wherein each of the guides comprises a second elongated conduit that is configured to be disposed below a portion of the one or more laths when the shutter is in the extended position.

33. The moon pool roller shutter as claimed in claim 32 wherein the second elongated conduit extends medially from a medial edge of the first elongated conduit, towards a medial portion of the shutter.

34. A moon pool roller shutter comprising:

a shutter moveable between a retracted position and an extended position, the shutter comprising one or more laths wherein the one or more laths each comprise first and second surfaces mechanically connected by first and second sides and one or more internal supports, each lath further comprising one or more wheel mechanisms that each comprise an axle, at least one end of which comprises a wheel, wherein the wheel rotates with respect to the lath, wherein the one or more internal supports each comprise a circular recess within which the axle is located such that a diameter of the axle reduces across a width of the one or more internal supports towards a second end of the axle, wherein the second end of each said axle comprises a barb that substantially unidirectionally fits the axle within the circular recess, and wherein each said circular recess comprises an opening that allows the one or more internal supports to collapse with respect to the first and second sides.

* * * * *